US006689228B2

(12) United States Patent
Köck et al.

(10) Patent No.: US 6,689,228 B2
(45) Date of Patent: Feb. 10, 2004

(54) DEVICE FOR TEMPERING ROLLED STOCK OF GREAT LENGTH

(75) Inventors: Norbert Köck, St. Peter-Freienstein (AT); Rainer Wahn, Leoben (AT)

(73) Assignee: Voest-Alpine Schienen GmbH & Co. KG, Leoben (AT)

( * ) Notice: Subject to any disclaimer, the term of this patent is extended or adjusted under 35 U.S.C. 154(b) by 0 days.

(21) Appl. No.: 09/998,159

(22) Filed: Dec. 3, 2001

(65) Prior Publication Data

US 2003/0047852 A1 Mar. 13, 2003

(30) Foreign Application Priority Data

Sep. 13, 2001 (AT) ..... 1442/2001

(51) Int. Cl.[7] ..... C21D 1/00
(52) U.S. Cl. ..... 148/128; 266/114
(58) Field of Search ..... 266/114; 148/128

(56) References Cited

U.S. PATENT DOCUMENTS 5,054,746 A 10/1991 Buchegger
6,336,980 B1 * 1/2002 Benedetti ..... 148/654
6,419,762 B2 * 7/2002 Prskawetz et al. ..... 148/333
6,432,230 B1 * 8/2002 Kock et al. ..... 266/114

FOREIGN PATENT DOCUMENTS

EP 0441766 8/1991

* cited by examiner

*Primary Examiner*—Scott Kastler
(74) *Attorney, Agent, or Firm*—Greenblum & Bernstein, P.L.C.

(57) ABSTRACT

A device and a process for tempering at least parts of the cross section of sequentially produced profiled rolling stock from the rolling heat and for the subsequent cooling thereof to room temperature. The device comprises a hardening device comprising at least to liquid cooling devices arranged next to each other and a transport device having rests for the rolling stock that can be moved across the entire hardening device. Thereby the liquid cooling devices can simultaneously and independently be supplied with rolling stock to be hardened.

27 Claims, 1 Drawing Sheet

DEVICE FOR TEMPERING ROLLED STOCK OF GREAT LENGTH

CROSS-REFERENCE TO RELATED APPLICATIONS

The present application claims priority under 35 U.S.C. §119 of Austrian Patent Application No. 1442/2001, filed Sep. 13, 2001.

BACKGROUND OF THE INVENTION

1. Field of the Invention

The invention relates to a device for the hardening of rolling stock having a large lengthwise extension at a high throughput. More precisely defined, the invention relates to a device for the thermal tempering of at least portions of the cross section over the lengthwise extension of sequentially produced profiled rolling stock from the rolling heat, in particular for hardening at least the head of rails having a length greater than 50 m, and subsequent cooling to room temperature, consisting essentially of a roller table, a means for arranging the rolling stock in axial alignment, a transport means having a rest for the rolling stock for the transport thereof in transverse direction, a hardening device with a manipulation arrangement, and a cooling bed.

2. Discussion of Background Information

In order to improve the properties of the material, a rolling stock is usually subjected to a thermal tempering treatment that advantageously is carried out with the use of the rolling heat. This tempering, which essentially affords an increase in the mechanical properties of the material such as hardness, abrasion resistance, and the like, can be performed over the entire cross section or, as is common with a running rail, only over partial sections of the same. Here, the rolling stock which is in its austenitic microstructural state, or partial sections of the cross section of the same, is dipped into a cooling medium over its entire length and, in this manner, a transformation of the microstructure is achieved in the desired manner.

Devices for carrying out such tempering processes are known (EP-0441766 B1) and have proven suitable with regard to an improvement of the use properties of railroad rails.

Depending on the final rolling temperature and depending on the specific mass or mass per length unit, respectively, of the rolling stock, thermal tempering thereof requires a corresponding submersion time or residence time in the cooling liquid, such that the throughput through the tempering device is limited. In other words, the maximum possible throughput through a submersion tempering installation with a cooling basin limits the output of the rolling device arranged before it.

Modern roll-forming lines with prearranged heating furnaces particularly for continuous casting input stock usually have potential rolling outputs that are greater than the throughput of known submersion tempering installations, so that with a sequential production of hardened rails, the rolling output has to be reduced.

In order to avoid this disadvantage, which is in particular an economic one, it has already been recommended to temper the rolling stock as it moves through a cooling path provided with spraying means. However, this continuous pass process requires long lengths of the installation and usually does not result in the required material quality of the rolling stock.

The invention aims at avoiding the deficiencies and, in particular, the economic disadvantages, of known thermal treatment installations for rolling stock of the type mentioned at the outset and at providing a device that ensures a high quality and good use properties of the rolling stock produced and has a high output and renders possible the treatment and thermal tempering of sequentially produced bar stock, particularly of rails having lengths of more than 50 m, on roll lines with high output while using rolling heat.

SUMMARY OF THE INVENTION

This goal is attained in a generic device in that the roller table has a device for longitudinally positioning the rolling stock which is supplied supported in at least one cross-sectional region, and an assigned alignment means, in that the hardening device is formed of at least two liquid cooling devices arranged next to one another essentially parallel in their lengthwise direction to the alignment means with manipulators for a movement of the rolling stock, in that the deposit region of the cooling bed is located next to, and parallel to the lengthwise extension of, the liquid cooling devices, and in that the means for transport in transverse direction has at least two supporting arms that are simultaneously movable between the roller table rolls, each having rolling stock rests arranged on the end side, that these rests on the supporting arms can be moved in transverse direction from the alignment position in the region of the roller table into the deposit region of the cooling bed, lowered, and raised in such a way that exclusively the rests protrude beyond the transport surface of the roller table and the upper edge of the roller table, respectively.

The present invention provides a device for tempering at least parts of the cross section of sequentially produced profiled rolling stock from the rolling heat and for the subsequent cooling thereof to room temperature. This device consists essentially of (a) a roller table that comprises rolls and receives said rolling stock, (b) an alignment device for axially aligning the rolling stock, (c) a transport device for transporting the rolling stock in transverse direction, (d) a hardening device for hardening the rolling stock which comprises a manipulator arrangement for manipulating the rolling stock to be hardened, and (e) a cooling bed for the hardened rolling stock, said cooling bed comprising a deposit region. The roller table (a) further comprises a positioning device for positioning in longitudinal direction the rolling stock which is supplied thereto, which positioning device comprises said alignment device (b). The transport device (c) comprises at least two supporting arms that are simultaneously movable between the rolls of the roller table. Each of these arms, in turn, comprises at an end section thereof a rest for supporting said rolling stock. The rests on the supporting arms can be moved in transverse direction from an alignment position in the region of the roller table into the deposit region of the cooling bed (e) and can be raised in such a way that only the rests are above an upper surface of the roller table. The hardening device (d) comprises at least two liquid cooling devices and manipulators for moving the rolling stock. These liquid cooling devices are arranged next to one another and essentially parallel to the alignment device (b). Furthermore, the deposit region of the cooling bed is arranged next to and parallel to the lengthwise extension of the liquid cooling devices.

In one aspect of the device, the rolling stock is a rail, e.g., a rail having a length of greater than 50 m. This rail may, for example, be a running rail or a railroad rail. In another aspect, at least the head of the rail is hardened. In yet another aspect, the roller table can support the rail in two cross-sectional regions thereof.

According to another aspect of the device, the positioning device comprises an electronically controllable device and/or an alignment bar and/or a stop.

According to still another aspect, the liquid cooling devices comprise submersion basins. These submersion basins may comprise stops for leveling and aligning the rolling stock. The stops may be arranged, for example, horizontally and/or vertically. In another aspect, a holding-down device for pressing down the rolling stock against said stops may additionally be provided.

According to a further aspect, each submersion basin has manipulators assigned to it. Each of said manipulators may be capable of, e.g., taking the rolling stock off the rests of the transport device (c), introducing the rolling stock into a submersion basin, lifting the rolling stock out of a submersion basin, and/or placing the rolling stock back on said rests. Moreover, said manipulators may be capable of introducing a rail "head down" into a submersion basin.

According to yet another aspect of the device, each of said supporting arms has exactly one rest arranged thereon. In another aspect, the supporting arms originate in the region of the roller table. Alternatively, the transport device (c) may be arranged in the region of the cooling bed.

The present invention also provides a process for tempering at least parts of the cross section of sequentially produced profiled rolling stock from the rolling heat and for subsequently cooling said rolling stock to room temperature. This process comprises axially aligning said rolling stock, transporting the rolling stock to a hardening device and treating at least parts of the cross section of the rolling stock therewith, and allowing the rolling stock so treated with the hardening device to cool to room temperature. In this process, the residence time in the hardening device exceeds the supply frequency of the rolling stock to be tempered and the process is carried out by means of a device as described above.

The advantages attained by the invention lie especially in the fact that, using the device, it is possible to position and axially align the rolling stock in a simple manner in sequence in the transverse transport region of the roller table with a high degree of precision, it being possible, by means of the rolling stock rests of the means for transport in transverse direction, to simultaneously, i.e., without interfering with the adjustment and the axial alignment process, transport a previously aligned and provided piece of rolling stock into the deposit regions of the cooling devices or from there into the deposit region of the cooling bed or from the roller table directly onto the cooling bed. In this connection, it is important that only the rolling stock rests of the supporting arms of the means for transport in transverse direction, which arms are movable between the rolls, are capable of being raised above the upper level of the rolls of the roller table or their transport surface, respectively. With this embodiment of the device, it is possible to arrange at least two hardening devices on one side of the roller table such that a cooling bed must be provided on one side only, which yields economic advantages. A piece of rolling stock that is positioned on the roller table and axially aligned can be lifted off the roller table by means of the rests of the supporting arms and, for example, be laid down in a deposit region of a liquid cooling device that is embodied as a manipulator. Thereafter the means for transport in transverse direction is freed up for transporting further pieces of rolling stock, where the manipulator can, alone and independently, orient the deposited rolling stock in its cross-sectional position, place it in the cooling medium at least partially, lift it out, and provide it for transport to the cooling bed. This separation of the transport in transverse direction of the rolling stock, which is essential to the invention, even past occupied cooling devices with, eventually, a deposit on the cooling bed, and a precise placement of the rolling stock in the cooling medium improves the precision of the manipulation as well as of the cooling treatment and reliably affords hardened rolled products with consistently high quality. In an advantageous and economical manner, the output and throughput, respectively, of the device is approximately doubled when using two hardening devices next to one another.

If the device is intended for a rolling stock in the form of a running rail or a railroad rail that rests on the roller table in two cross-sectional regions and the positioning device is embodied as an electronically controllable means and/or has an alignment bar or a lateral stop, it is possible in a favorable fashion for the residence time of the rails on the roller table to be reduced, for the temperature control to be improved, and, optionally, for the output of the installation to be increased. Moreover, this position is particularly well suited for a so-called "head down" vertical positioning of the rail by means of the manipulators.

If, as may be provided in one embodiment of the invention, the liquid cooling devices are formed as submersion basins that have horizontally and vertically oriented stops acting on the bottom and, optionally, laterally for leveling and aligning the rolling stock, it is possible, in particular in the case of the cooling of parts of the cross section of a rail, for a highly consistent cooling and distribution of hardness to be achieved over its length, which helps to ensure the quality of the product.

It is advantageous for consistent and good use properties if holding-down means for the rolling stock, in particular for a rail, are provided in the device, with which means the rolling stock/rail can be pressed down against the leveling stops in the submersion basin during cooling because this can effectively prevent a bending caused by the cooling and keep the respective local cooling of the surface completely constant.

Particular economic advantages are provided by using the device described above for hardening at least the head of rails having a length of greater than 50 m and subsequent cooling to room temperature at a pass-through time of a rail through the hardening device that exceeds the supply frequency because large increases in performance are possible at comparably low investment costs.

BRIEF DESCRIPTION OF THE DRAWINGS

In the following, the invention will be described with reference to a drawing which shows one embodiment only, with the reference characters, each of which is kept the same, being listed below.

List of Reference Characters:

Figure 1:
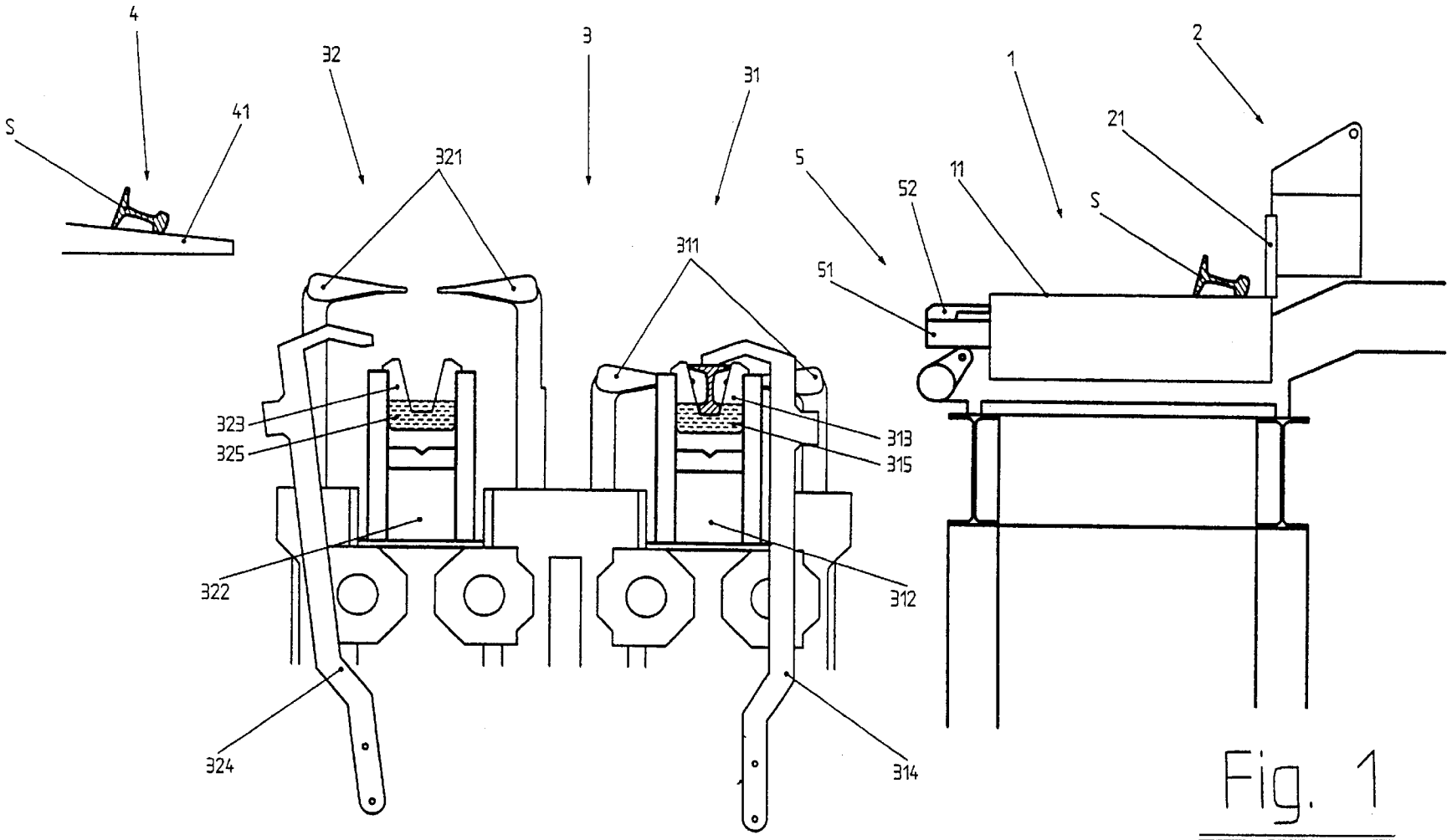

S Rolling stock
1 Roller table
11 Transport surface of the roller table
2 Alignment means
21 Alignment bar
3 Hardening device
31 Liquid cooling devices
32
311 Manipulators
321
312 Submersion basins
322

313 Leveling stops
323
314 Holding-down means
324
315 Cooling liquid
325
4 Cooling bed
41 Deposit region of the cooling bed
5 Means for transport in transverse direction
51 Supporting arm
52 Rolling stock rest

DETAILED DESCRIPTION OF THE INVENTION

FIG. 1 shows a device according to the invention with a hardening device 3 consisting of two liquid cooling devices 31 and 32 that are arranged between a roller table 1 and a cooling bed 4. In the exemplary schematic depiction, the head of the rail S is shown submerged in a cooling liquid 315 in one of the liquid cooling devices 31. By means of holding-down means 314 and leveling stops 313, the rail can be positioned in a submersion basin 312 in such a way that precisely only an accelerated head cooling of the same takes place. However, using stops 313 positioned farther below the surface of a cooling liquid 315, it is also possible to cool the entire cross section of the rail in an accelerated manner. A second liquid cooling device 32 stands ready.

As FIG. 1 further shows, a rail S coming from a line of rollers (not shown) is positioned on the roller table 1 and can be arranged with its axis aligned by means of an alignment means 2 optionally having an alignment bar 21. A means 5 for transport in transverse direction with supporting arms 51 and one rolling stock rest 52 each is arranged such that it can be moved back into the region of the roller table 1. However, it is also possible to establish such a means 5 for transport in transverse direction in the region of the cooling bed.

For transport in transverse direction, a simultaneous displacement of the supporting arms 51 is carried out in such a way that the rolling stock rests 52 arranged thereon, when raised, can lift the rail S off the roller table 1 in an axially aligned manner, carry it, and move it transversely in the direction of the cooling bed 4. Here, it is essential to the invention that, in the course of a transport in transverse direction, exclusively the rolling stock rests 52 of the means 5 for transport in transverse direction can vertically protrude above a transport surface 11 of the roller table, even if the deposits 52 are moved into the outermost opposing region, for example, when placing a rail S on a deposit region 41 of the cooling bed 4.

A positioned and axially aligned rail S, which lies on the transport surface 11 of the roller table 1, advantageously in two cross-sectional regions, can now be vertically lifted in this position by means of the rolling stock rest 52 and be moved essentially horizontally or transversely to a stand-by liquid cooling device in FIG. 1, item 32. Such a cross-sectional position of the rail S on the rolling stock rests 52 is favorable for reception of the same and a "head down" vertical positioning by means of a manipulator 321, by means of which a lowering or introduction of the rail head into a cooling liquid 325 can be carried out as well. During the residence time of the rail in the cooling liquid 325, the rail can be clamped by means of holding-down means 324 and leveling stops 323 for the purpose of stabilization.

Because, as previously mentioned, according to the invention, exclusively the rolling stock rests 52 can be brought to a level that lies above the transport surface 11 of the roller table 1, it is possible, despite transverse transport activities, to bring a subsequent rail from the rolling works onto the roller table 1 and to position and align it thereon. The removal of a rail S from the liquid cooling devices 31, 32 by means of manipulators 311, 321 and a taking off thereof by means of the rolling stock rests 52 can be carried out in essentially the same manner, whereupon a transport and deposit onto the deposit region 41 of the cooling bed 4 take place.

In the case of high rolling output, the hardening device 3 can also be equipped with more than two liquid cooling devices, but a programmable control unit may advantageously be used for a production sequence.

What is claimed is:

1. A device for tempering at least parts of the cross section of sequentially produced profiled rolling stock from the rolling heat and for the subsequent cooling thereof to room temperature, wherein said device consists essentially of (a) a roller table comprising rolls for receiving said rolling stock, (b) an alignment device for axially aligning the rolling stock, (c) a transport device for transporting the rolling stock in transverse direction, (d) a hardening device for hardening the rolling stock, said hardening device comprising a manipulator arrangement for manipulating the rolling stock to be hardened, (e) a cooling bed for the hardened rolling stock, said cooling bed comprising a deposit region, wherein said roller table (a) comprises a positioning device for positioning in longitudinal direction the rolling stock which is supplied thereto, said positioning device comprising said alignment device (b), wherein said transport device (c) comprises at least two supporting arms that are simultaneously movable between said rolls of said roller table (a), each arm comprising at an end section thereof a rest for supporting said rolling stock, the rests on the supporting arms being capable of being moved in transverse direction from an alignment position in the region of the roller table (a) into said deposit region of said cooling bed (e) and of being raised in such a way that only the rests are above an upper surface of said roller table (a), wherein said hardening device (d) comprises at least two liquid cooling devices and manipulators for moving the rolling stock, said liquid cooling devices being arranged next to one another and essentially parallel to said alignment device (b), and wherein the deposit region of said cooling bed is arranged next to and parallel to the lengthwise extension of said at least two liquid cooling devices.

2. The device of claim 1, wherein said roller table (a) is capable of supporting said rail in two cross-sectional regions thereof.

3. The device of claim 1, wherein said positioning device comprises an electronically controllable device.

4. The device of claim 1, wherein said positioning device comprises an alignment bar.

5. The device of claim 1, wherein said positioning device comprises a stop.

6. The device of claim 1, wherein said liquid cooling devices comprise submersion basins.

7. The device of claim 6, wherein said submersion basins comprise stops for leveling and aligning the rolling stock.

8. The device of claim 7, wherein said stops are at least one of horizontally and vertically arranged.

9. The device of claim 7, wherein the device further comprises a holding-down device for pressing down the rolling stock against said stops.

10. The device of claim 6, wherein each submersion basin has manipulators assigned to it.

11. The device of claim 10, wherein each of said manipulators is capable of at least one of taking the rolling stock off said rests of said transport device (c), introducing said rolling stock into a submersion basin, lifting said rolling stock out of a submersion basin and placing said rolling stock on said rests.

12. The device of claim 10, wherein said manipulators are capable of introducing a rail "head down" into a submersion basin.

13. The device of claim 1, wherein each of said supporting arms has one rest arranged thereon.

14. The device of claim 13, wherein said supporting arms originate in the region of the roller table (a).

15. The device of claim 1, wherein said transport device (c) is arranged in the region of the cooling bed (e).

16. A device for tempering at least parts of the cross section of sequentially produced rails having a length of greater than 50 m from the rolling heat and for subsequently cooling them to room temperature, wherein said device consists essentially of (a) a roller table comprising rolls for receiving the rails, (b) an alignment device for axially aligning the rails, (c) a transport device for transporting the rails in transverse direction, (d) a hardening device for hardening the rails, said hardening device comprising a manipulator arrangement for manipulating the rails to be hardened, (e) a cooling bed for the hardened rails, said cooling bed comprising a deposit region, wherein said roller table (a) comprises a positioning device for positioning in longitudinal direction the rails supplied thereto, said positioning device comprising said alignment device (b), wherein said transport device (c) comprises at least two supporting arms that originate in the region of the roller table (a) and are simultaneously movable between said rolls of said roller table, each arm comprising at an end section thereof one rest for supporting said rails, the rests on the supporting arms being capable of being moved in transverse direction from a rail alignment position in the region of the roller table (a) into the deposit region of said cooling bed (e) and of being raised in such a way that only the rests are above an upper surface of said roller table (a), wherein said hardening device (c) comprises at least two submersion basins arranged next to one another and essentially parallel to said alignment device (b), each basin having manipulators assigned to it, said manipulators being capable of taking the rails off said rests of said transport device (c), introducing said rails into a submersion basin, lifting said rails out of a submersion basin and placing said rails on said rests, and wherein the deposit region of said cooling bed (e) is arranged next to and parallel to the lengthwise extension of said at least two liquid cooling devices.

17. The device of claim 16, wherein said positioning device comprises at least one of an electronically controllable device, an alignment bar and a stop.

18. The device of claim 16, wherein said submersion basins comprise stops for leveling and aligning the rolling stock.

19. The device of claim 18, wherein said stops are arranged at least one of horizontally and vertically.

20. The device of claim 19, wherein the device further comprises a holding-down device for pressing down the rolling stock against said stops.

21. A process for tempering at least parts of the cross section of sequentially produced profiled rolling stock from the rolling heat and for subsequently cooling said rolling stock to room temperature, said process comprising axially aligning said rolling stock, transporting the rolling stock to a hardening device and treating at least parts of the cross section of the rolling stock therewith, and allowing the rolling stock so treated with the hardening device to cool to room temperature, wherein the residence time in the hardening device exceeds the supply frequency of the rolling stock to be tempered and the process is carried out by means of a device which consists essentially of (a) a roller table comprising rolls for receiving said rolling stock, (b) an alignment device for axially aligning the rolling stock, (c) a transport device for transporting the rolling stock in transverse direction, (d) said hardening device, comprising a manipulator arrangement for manipulating the rolling stock to be hardened, (e) a cooling bed for the hardened rolling stock, said cooling bed comprising a deposit region, wherein said roller table (a) comprises a positioning device by which the rolling stock supplied thereto is positioned in longitudinal direction, said positioning device comprising said alignment device (b), wherein said transport device (c) comprises at least two supporting arms that are simultaneously movable between said rolls of said roller table (a), each arm comprising at an end section thereof a rest for supporting said rolling stock, the rests on the supporting arms being moved in transverse direction from an alignment position in the region of the roller table (a) into said deposit region of said cooling bed (e) and being raised in such a way that only the rests are above an upper surface of said roller table (a), wherein said hardening device (d) comprises at least two liquid cooling devices and manipulators for moving the rolling stock, said liquid cooling devices being arranged next to one another and essentially parallel to said alignment device (b), and wherein the deposit region of said cooling bed is arranged next to and parallel to the lengthwise extension of said at least two liquid cooling devices.

22. The process of claim 21, wherein said rolling stock is a rail.

23. The process of claim 22, wherein said rail has a length of greater than 50 m.

24. The process of claim 23, wherein at least a head of the rail is hardened.

25. The process of claim 22, wherein said liquid cooling devices comprise submersion basins.

26. The process of claim 25, wherein said submersion basins comprise stops for leveling and aligning the rolling stock.

27. The process of claim 26, wherein the device further comprises a holding-down device for pressing down the rolling stock against said stops.

* * * * *

UNITED STATES PATENT AND TRADEMARK OFFICE

CERTIFICATE OF CORRECTION

PATENT NO. : 6,689,228 B2
DATED : February 10, 2004
INVENTOR(S) : N. Köck et al.

It is certified that error appears in the above-identified patent and that said Letters Patent is hereby corrected as shown below:

Column 6,
Line 51, “rail” should be -- rolling stock --.

Signed and Sealed this

Twenty-eighth Day of June, 2005

JON W. DUDAS
*Director of the United States Patent and Trademark Office*